US008366456B2

(12) United States Patent
Wu

(10) Patent No.: US 8,366,456 B2
(45) Date of Patent: Feb. 5, 2013

(54) CABLE CONNECTOR ASSEMBLY WITH ALIGNED CABLE ARRANGEMENT

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/015,318

(22) Filed: Jan. 27, 2011

(65) Prior Publication Data

US 2011/0195614 A1 Aug. 11, 2011

(30) Foreign Application Priority Data

Feb. 9, 2010 (CN) ..... 2010 2 0302643

(51) Int. Cl.
*H01R 12/00* (2006.01)

(52) U.S. Cl. ..... 439/76.1

(58) Field of Classification Search ..... 439/607.01, 439/76.1
See application file for complete search history.

(56) References Cited

U.S. PATENT DOCUMENTS

| | | | | |
|---|---|---|---|---|
| 6,343,957 | B1 * | 2/2002 | Kuo et al. | 439/638 |
| 7,029,290 | B2 * | 4/2006 | Wu | 439/76.1 |
| 7,147,502 | B1 * | 12/2006 | Wu | 439/352 |
| 7,261,582 | B2 * | 8/2007 | Wu | 439/352 |
| 7,462,071 | B1 * | 12/2008 | Wu | 439/607.05 |
| 7,651,341 | B2 | 1/2010 | Wu | |
| 2004/0087217 | A1 * | 5/2004 | Hyland et al. | 439/676 |
| 2005/0003707 | A1 * | 1/2005 | Wu | 439/579 |
| 2009/0253292 | A1 * | 10/2009 | Wu | 439/493 |
| 2010/0015851 | A1 * | 1/2010 | Wu | 439/607.01 |

* cited by examiner

*Primary Examiner* — Briggitte R Hammond
(74) *Attorney, Agent, or Firm* — Wei Te Chung; Ming Chieh Chang

(57) ABSTRACT

A cable connector assembly includes a conductive housing including a base in cooperation with a cover to define a receiving cavity, a pair of first and second PCBs received in the receiving cavity at different levels, and at least two cables located at a same level at a rear wall of the housing. The receiving cavity includes a hollow portion and a mating port located in front of the hollow portion. Both PCBs have mating interfaces extending into the mating port and mounting portions located within the hollow portion. The at least two cables electrically connect to the mounting portions of the first and second PCBs, respectively.

8 Claims, 8 Drawing Sheets

CABLE CONNECTOR ASSEMBLY WITH ALIGNED CABLE ARRANGEMENT

BACKGROUND OF THE INVENTION

1. Field of the Invention

The present invention relates generally to a cable connector assembly, and more particularly to a cable connector assembly with aligned cables arrangement.

2. Description of Related Art

U.S. Pat. No. 7,651,341 issued to Jerry Wu on Jan. 26, 2010 discloses a cable connector assembly. The cable connector assembly comprises a housing enclosing a receiving cavity, a pair of first and second printed circuit boards apart from one another along a vertical direction, and at least two cables. The receiving cavity includes a hollow portion and a mating port disposed in front of the hollow portion. Said pair of first and second printed circuit boards have mating interfaces extending into the mating port and mounting portions located within the hollow portion. The at least two cables are arranged at different levels at a rear wall of the housing and electrically connecting to the mounting portions of the first and second printed circuit boards. The structure with the above cables arrangement leads to increase the height of the connector assembly.

Hence, it is desired to provide a cable connector assembly to overcome the problems mentioned above.

BRIEF SUMMARY OF THE INVENTION

A cable connector assembly comprises a conductive housing comprising a base in cooperation with a cover to define a receiving cavity, a pair of first and second PCBs received in the receiving cavity at different levels, and at least two cables located at the same level at a rear wall of the housing. The receiving cavity includes a hollow portion and a mating port located in front of the hollow portion. Both PCBs have mating interfaces extending into the mating port and mounting portions located within the hollow portion. The at least two cables electrically connect to the mounting portions of the first and second PCBs, respectively.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
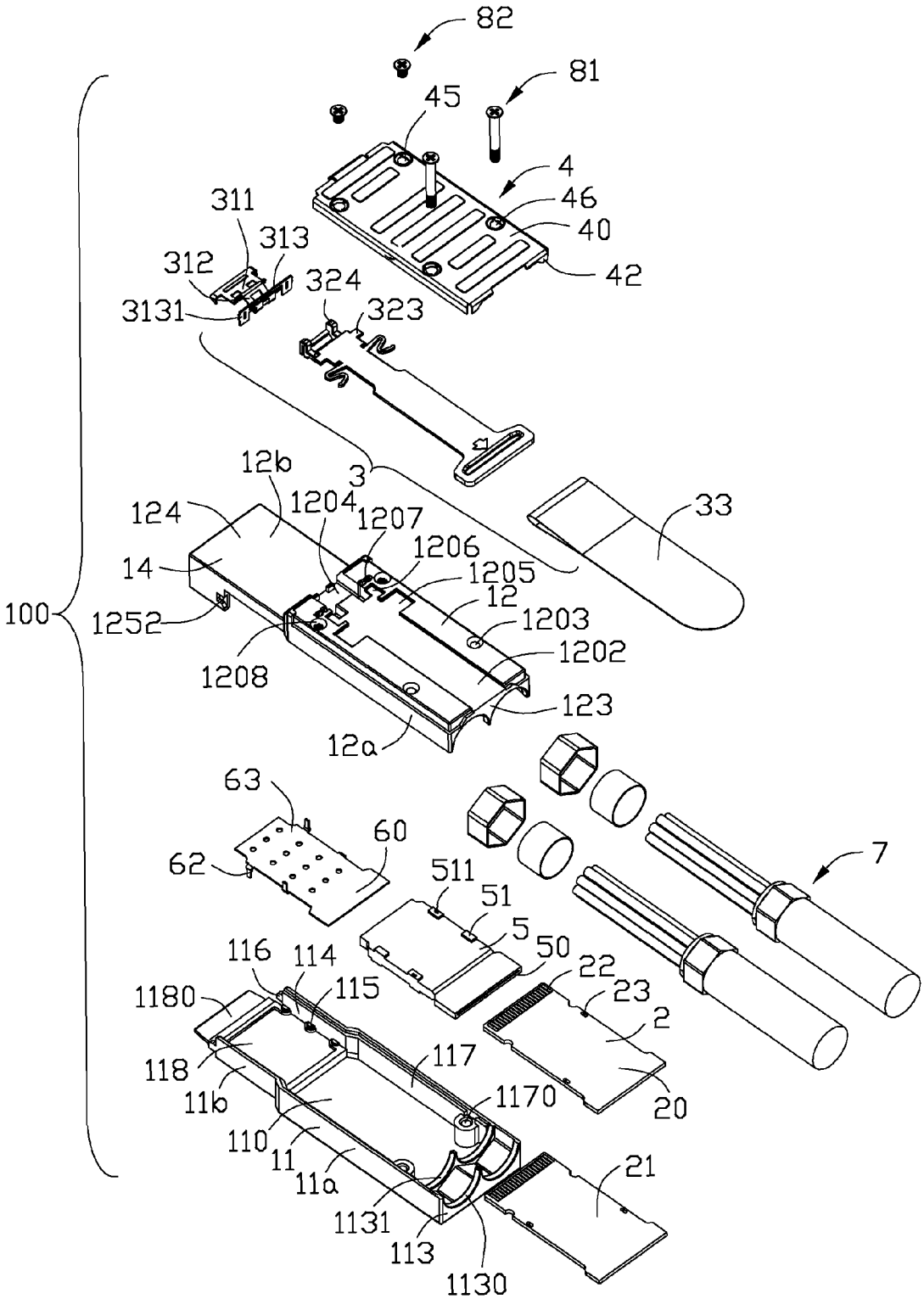
FIG. 1 is an exploded, perspective view of a cable connector assembly according to the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
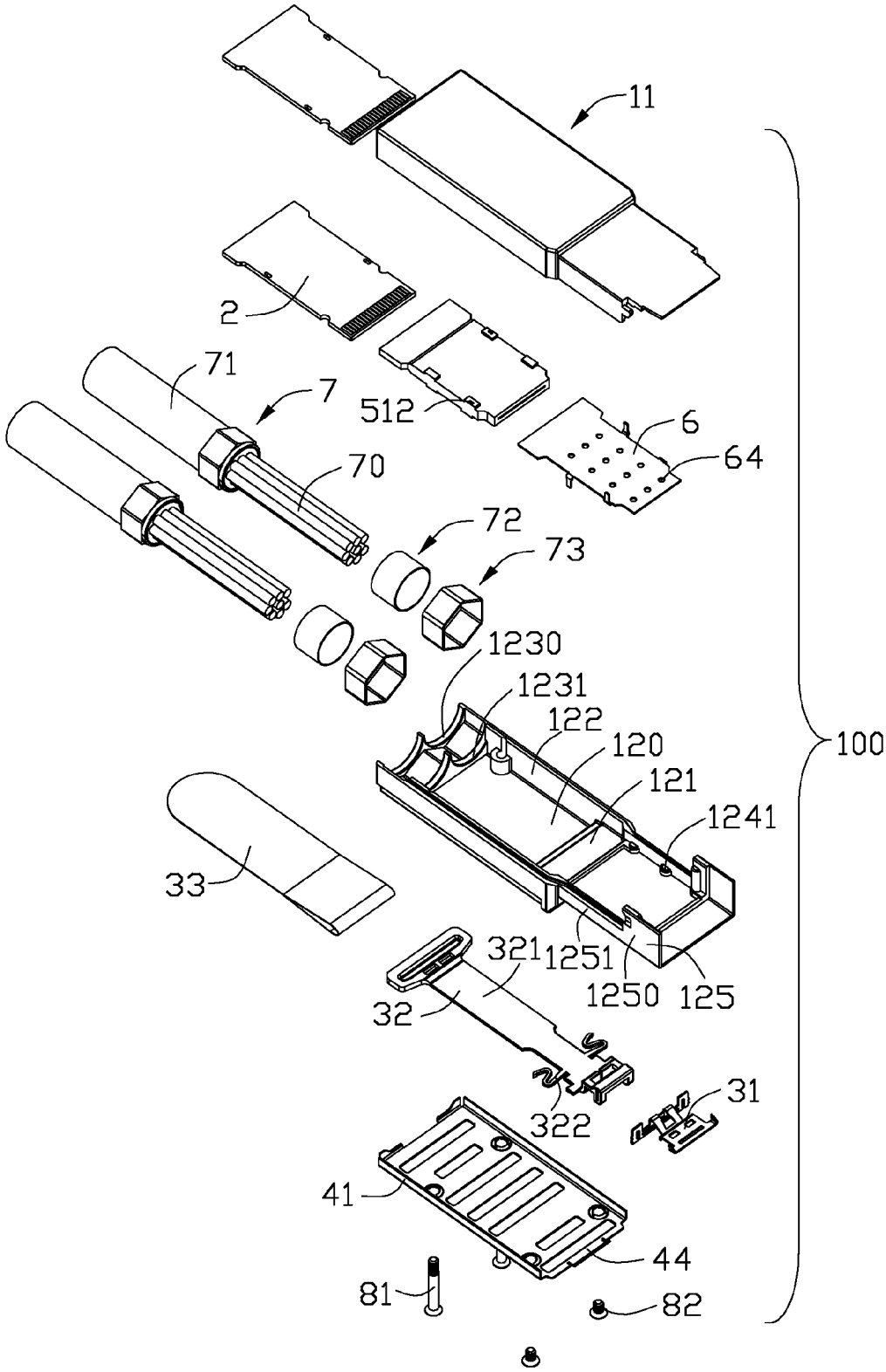
FIG. 2 is a view similar to FIG. 1, but viewed from a different aspect.
Figure 3:
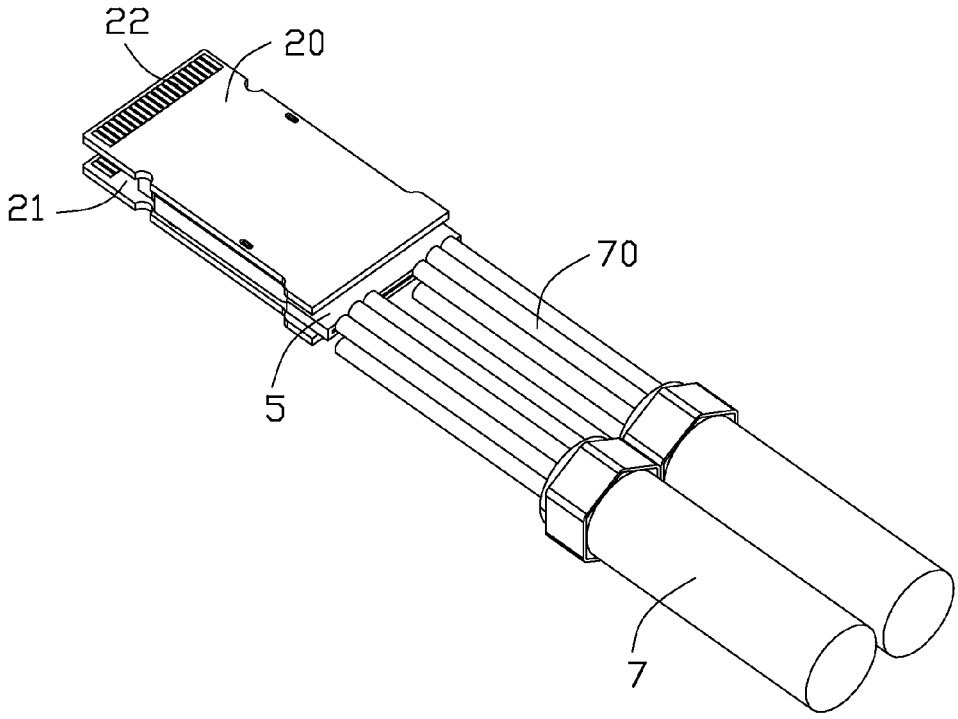
FIG. 3 is a part, assembled view of the cable connector assembly shown in FIG. 1.
Figure 4:
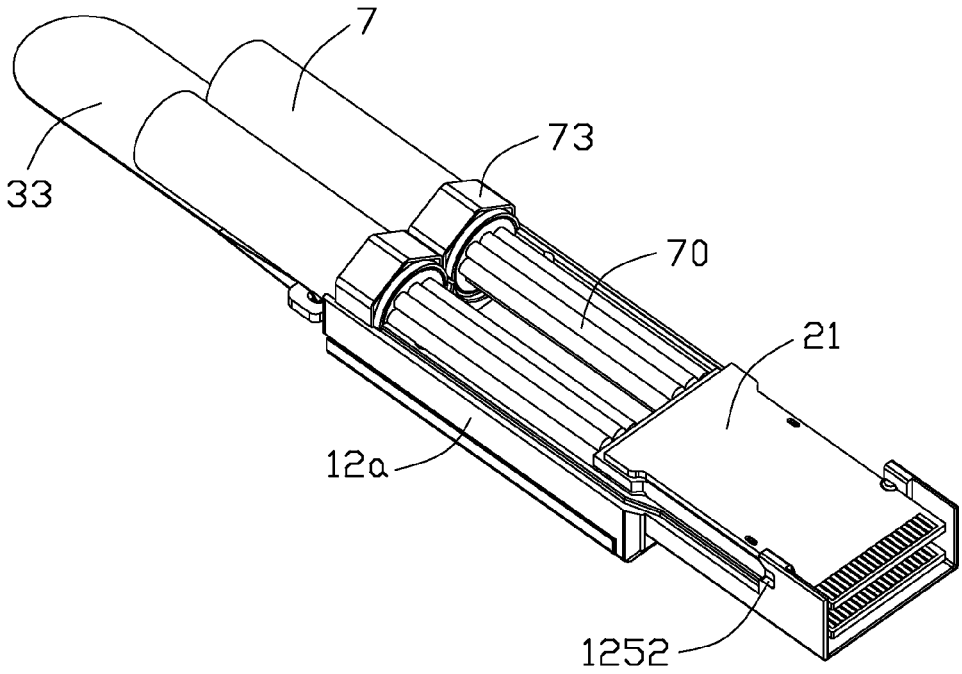
FIG. 4 is another part, assembled view of the cable connector assembly shown in FIG. 1.
Figure 5:
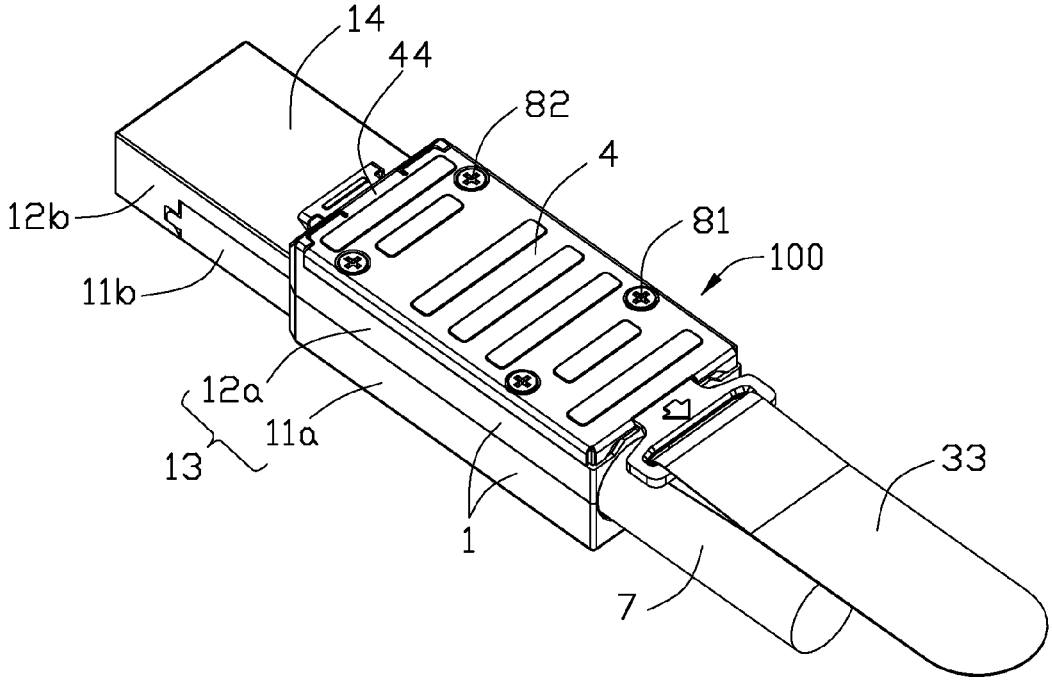
FIG. 5 is an assembled view of the cable connector assembly shown in FIG. 1.
Figure 6:
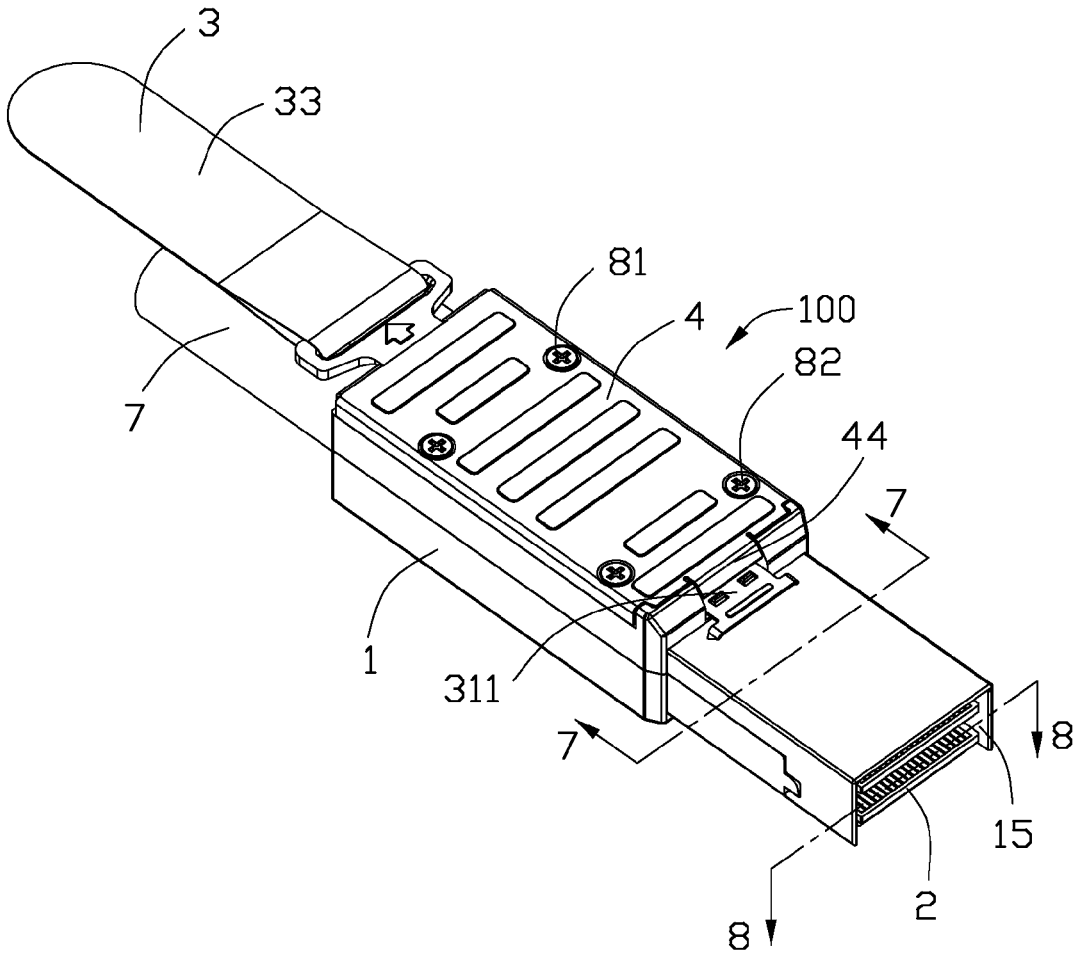
FIG. 6 is another assembled view of the cable connector assembly shown in FIG. 1.
Figure 7:
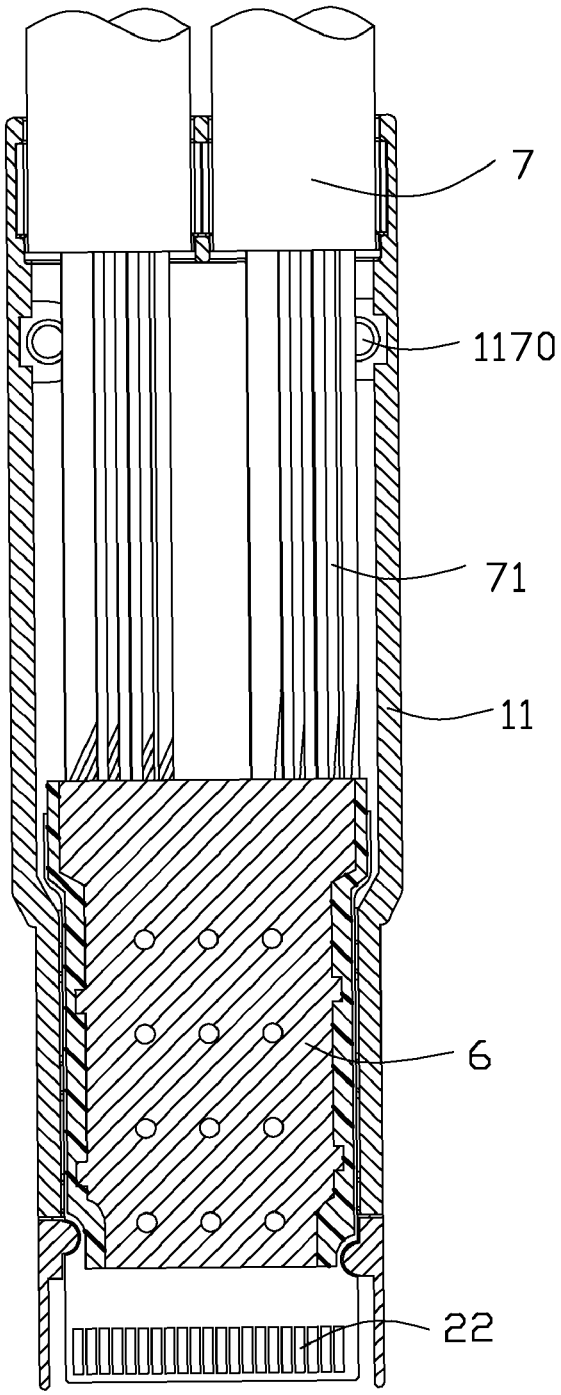
FIG. 7 is a cross-section view taken along line 7-7 of FIG. 6.
Figure 8:
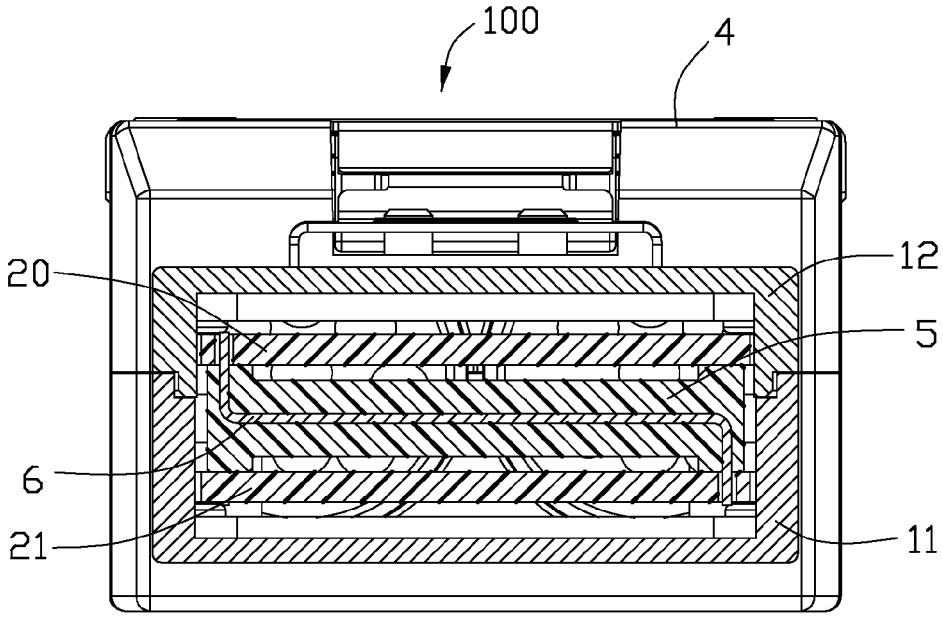
FIG. 8 is a cross-section view taken along line 8-8 of FIG. 6.

Referring to FIG. 6 combination with FIGS. 1, 2 and 5, a cable connector assembly 100 in accordance with the present invention comprises a shell housing 1 defining a receiving cavity 15, a pair of printed circuit boards (PCBs) 2 located in the housing 1 at different levels, two cables 7 electrically connecting with the PCBs 2 at a rear end of the housing, and a latch mechanism 3 assembled to the housing 1 at the rear end of the housing. The receiving cavity 15 includes a hollow portion and a mating port located in front of the hollow portion. The PCBs 2 extend into the mating port of the receiving cavity 15. A description of said elements will be given hereinafter.

Please refer to FIGS. 1 and 2, the shell housing 1 of the present invention is made of metal material and comprises a base 11, a cover 12 coupled with the base 11 to form said receiving cavity 15 between the base 11 and the cover 12 and to construct with a rear rectangular base portion 13 and an elongated mating portion 14 extending forwardly from the base portion 13.

The base 11 comprises a first base section 11*a* and a first mating section 11*b* extending forwardly from the first base section 11*a*. The first base section 11*a* comprises a first flat main portion 110, a pair of first side walls 117 and a first rear flange 113 respectively extending upwardly from opposite side edges and rear edge of the first flat main portion 110. The first rear flange 113 comprises two rear walls parallel to each other. One rear wall has a pair of first semicircular openings 1130 and the other rear wall has a pair of second semicircular openings 1131 aligned with the first openings 1130 in the front-rear direction. A pair of position holes 1170 is defined in the rear section of the main portion 110 and adjacent to the respective first side walls 117.

The first mating section 11*b* comprises a first flat main portion 118 and a pair of side walls 114 extending upwards from opposite sides of the first flat main portion 118. Each side wall 114 is formed with a protrusion 116 extending forwardly therefrom. An extension portion 1180 is formed at the front edge of the first flat main portion 118 and extends beyond free ends of the protrusions 116. Two rows of first standoffs 115 are formed on the first flat main portion 118 and arranged adjacent to the respective side walls 114.

The cover 12 comprises a second base section 12*a* and a second mating section 12*b* extending forwardly from the second base section 12*a*. The second base section 12*a* comprises a second flat main portion 120, a pair of second side walls 122 and a second rear flange 123 extending downwardly from opposite side edges and a rear edge of the second flat main portion 120. The rear flange 123 comprises two rear walls parallel to each other. One wall has a pair of third semicircular openings 1230 formed therein and the other wall has a pair of forth semicircular openings 1231 aligned with the third opening 1230 in the front and rear direction.

The upper portion of the second main portion 120 defines a first channel portion 1202 arranged in a middle section thereof and a lower second channel portion 1204 in front of the first channel portion 1202. The second channel portion 1204 communicates with the first channel portion 1202. A pair of first grooves 1205 is located in the middle section of the main portion 120 and further communicates with the first channel portion 1202. A pair of second grooves 1206 is in front of the first grooves 1205 and also communicates with the first channel portion 1202. A pair of slots 1207 is recessed downwardly from a top surface of a front section of the main portion 120 and communicates with the second channel portion 1204. A pair of first screw holes 1203 is recessed downwardly and located at opposite sides of the first channel portion 1202. The pair of first screw holes 1203 penetrates through the top and bottom surfaces of the second main portion 120. In addition, the second main portion 120 forms a plurality of steps 121 extending therefrom with different height. A pair of second screw holes 1208 is recessed downwardly from the top surface of the second main portion 120 in a certain depth and located at opposite sides of second grooves 1206.

The second mating section 12*b* comprises a second flat base portion 124 and a pair of L-shaped side walls 125 extending downwardly from opposite sides of the second panel 124. Each side wall 125 comprises a front portion 1250 and a narrower rear portion 1251. A pair of recesses 1252 is formed in rear ends of the front portions 1250 to receive the protrusions 116. Two rows of second standoffs 1241 protrudes from the second panel 124. The base and the cover are retained together by bolts 81, 82 inserted in the holes.

The pair of PCBs 2 includes a first PCB 20 and a second PCB 21 similar to and beneath the first PCB 20. Two groups of first conductive pads 22 are respectively arranged on a front segment of the PCBs 20, 21 to form the mating interface, and two groups of second conductive pads are respectively arranged on the rear segment of the PCBs 20, 21 to form the mounting portion. Each PCB has two through holes 23 formed therein.

An optional latch mechanism 3 is assembled to the housing 1 of the cable connector 100. The latch mechanism 3 includes a latch member 31, an actuator 32 and a pull tape 33 attached to a rear portion of the actuator 32. The actuator 32 has a main body 321 received in the first channel portion 1202, a pair of claw-shaped spring members 322 arranged at lateral sides of a front segment of the main body 321 and received in the first grooves 1205, a pair of stopper 323 disposed in front of the spring members 322 and arranged at the lateral sides of the main body 321 and received in the second grooves 1206, an engaging portion 324 formed at the front end of the main body 321 and received in the second channel portion 1204. The latch member 31 comprises a latch portion 311 disposed above the second mating section 12*b*, an engaging segment 313 attached to the second base section 12*a*, and a pair of ear portions 3131 interferentially received in the pair of slots 1207 of the second base section 12*a*, an N-shaped interconnecting portion 312 disposed above the engaging portion 324 of the actuator 32.

A conductive shell 4 comprises a body portion 40, a pair of lateral walls 41 extending downwardly from opposite sides of the body portion 40, a rear wall 42 extending downwardly from a rear side of the body portion 40 and a spring member 44 formed at a front edge of the body portion 40. A pair of third screw holes 45 and a pair of forth screw holes 46 are respectively formed at front portion and rear portion of the body portion 40.

A spacer 5 defines an upper surface and an opposite lower surface. Two rows of first protrusion members 51 extend upwardly from the upper surface of the spacer 5. Each row has two protrusion members 51. The rear first protrusion member 51 in the left row and the front first protrusion 51 in the right row respectively has a first cavity 511 therein. Another two rows of second protrusion members 51 extend downwardly from the lower surface. The front second protrusion member 51 in the left row and the rear second protrusion member 51 in the right row respectively has a second cavity 512 therein. A slot 50 is formed in the rear end of the spacer 5.

The cable connector assembly 100 further comprises a metal sheet 6 is embedded in the spacer 5. The metal sheet 6 is located in the slot 50 of the spacer 5 and electrically connects with the first and second PCBs so as to suppress electro magnetic interference. The metal sheet 6 comprises a base portion 61 and a panel portion 63 extending forwardly from the base portion 61. A plurality of through holes 64 is formed in the panel portion 63. A pair of position tabs 62 extends upwardly and is received in the first cavities 511, and another pair of position tabs 62 extends downwardly and is received in the second cavities 512.

Two cables are located at the same level at a rear wall of the housing and electrically connecting to the mounting portions of the first and second PCBs, respectively. Each of the two cables 7 includes a number of wires 70 and an insulated jacket 71 enclosing thereon. A circular-shaped inner ring member 72 is inserted into an interior portion of the insulated jacket 71 of the front portion of the cable 7 to serve as a strain relief. A hexagon-shaped outer ring 73 is crimped to a front portion of the cable 7 and disposed outside of the insulated jacket 71.

When assembly, the wires 70 of one cable 7 are soldered to the conductive pads (not shown) of the second PCB 21, then the second PCB 21 is assembled in the base 11 and supported by the first standoffs 115. Secondly, the spacer 5 is disposed on the second PCB 21, with the pair of position tabs 62 inserted into the second cavities 512 and the through holes 23 of the second PCB 21. Thirdly, the first PCB 20 is disposed on the spacer 5, with the other pair of position tabs 62 inserted into the first cavities 511 and the through holes 23 of the first PCB 20, the spacer 5 and the two PCBs 20, 21 are separated and parallel to each other. Fourthly, the wires 70 of the other cable 7 are soldered to conductive pads (not shown) of the first PCB 20. Fifthly, the cover 12 is assembled to the base 11, with the second standoffs 1241 thereon pressed onto the first PCB 20. Sixthly, the latch mechanism 3 is assembled to the cover 12. Seventhly, the conductive shell 4 is assembled to the cover 12 to fix the latch mechanism 3, with the body portion 40 of the conductive shell 4 shielding the second base section 12*a*, the spring member 44 of the conductive shell 4 pressing onto the latch portion 311. A pair of first bolts 81 and a pair of second bolts 82 are assembled to the cover 12 and the base 11 to combine them together with the conductive shell 4. The pair of first semicircular openings 1130 and the pair of second semicircular openings 1131 with the same size are located at the same level. The hexagon-shaped outer rings 73 are respectively placed on the first semicircular openings 1130 and the second semicircular openings 1131 so that the two cables 7 are situated at the same level to reduce the height of the cable connector assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly comprising:

a housing comprising a base in cooperation with a cover to define a receiving cavity, the receiving cavity including a hollow portion and a mating port located in front of the hollow portion;

a pair of first and second PCBs received in the receiving cavity at different levels, both PCBs having mating interfaces extending into the mating port and mounting portions located within the hollow portion;

a spacer interposed between the pair of first and second PCBs, said spacer cooperating the housing to fix the pair of PCBs within the receiving cavity;

a metal sheet disposed in a slot of the spacer, at least one position tab extending upwardly from the metal sheet to electrically connect the first PCBs, at least another position tab extending downwardly from the metal sheet to electrically connect the second PCBs; and at least two cables located at a rear wall of the housing and electrically connecting to the mounting portions of the first and second PCBs, respectively;

wherein the spacer defines an upper surface and comprises at least one standoff extending upwardly from the upper surface and having a cavity therein, the at least one position tab penetrating through the cavity.

2. The cable connector assembly as claimed in claim 1, wherein the spacer defines a lower surface and comprises at least one standoff extending downwardly from the lower surface and having a cavity therein, the at least another position tab penetrating through the cavity.

3. A cable connector assembly comprising:

an housing defining a receiving cavity;

a pair of printed circuit boards commonly received in the receiving cavity in a parallel relation;

an insulative spacer sandwiched between said pair of printed circuit board;

a metal sheet embedded within the spacer and equipped with at least a pair of grounding tangs respectively upwardly and downwardly extending toward and contacting the pair of printed circuit boards;

a pair of cables side by side, in a transverse direction, located behind the printed circuit board, a centerline of each of said cables essentially close to the spacer; and a latch mechanism attached to an exterior face of the housing;

wherein the at least a pair of grounding tangs extend upwardly and downwardly through the corresponding pair of printed circuit boards, respectively.

4. The cable connector assembly as claimed in claim 3, wherein said metal sheet further includes another pair of grounding tangs respectively upwardly and downwardly extending toward and contacting the pair of printed circuit boards.

5. The cable connector assembly as claimed in claim 3, wherein said pair of grounding tangs are spaced from each other in the transverse direction.

6. The cable connector assembly as claimed in claim 5, wherein said metal sheet further includes another pair of grounding tangs respectively upwardly and downwardly extending toward and contacting the pair of printed circuit boards.

7. The cable connector assembly as claimed in claim 6, wherein said another pair of grounding tangs are spaced from each other in the transverse direction.

8. The cable connector assembly as claimed in claim 7, wherein the pair of grounding tangs are essentially reversely arranged with said another pair of grounding tangs in the transverse direction.

* * * * *